US011428510B2

(12) United States Patent
Arnold et al.

(10) Patent No.: US 11,428,510 B2
(45) Date of Patent: Aug. 30, 2022

(54) ELECTRIC CLAY TARGET THROWER AND RELATED METHODS

(71) Applicant: Ferus Outdoors LLC, Huntersville, NC (US)

(72) Inventors: Greg Arnold, Huntersville, NC (US); Kevin Gillis, Huntersville, NC (US)

(73) Assignee: Ferus Outdoors LLC, Huntersville, NC (US)

( * ) Notice: Subject to any disclaimer, the term of this patent is extended or adjusted under 35 U.S.C. 154(b) by 0 days.

(21) Appl. No.: 17/334,444

(22) Filed: May 28, 2021

(65) Prior Publication Data

US 2021/0372743 A1 Dec. 2, 2021

Related U.S. Application Data

(60) Provisional application No. 63/114,294, filed on Nov. 16, 2020, provisional application No. 63/032,268, filed on May 29, 2020, provisional application No. 63/032,262, filed on May 29, 2020.

(51) Int. Cl.
*F41J 9/24* (2006.01)

(52) U.S. Cl.
CPC ..... *F41J 9/24* (2013.01)

(58) Field of Classification Search
CPC . F41J 9/18; F41J 9/20; F41J 9/24; F41J 9/32; A63B 69/40; A63B 69/407; A63B 69/408
USPC ..... 124/6, 7, 8, 9
See application file for complete search history.

(56) References Cited

U.S. PATENT DOCUMENTS 3,612,025 A * 10/1971 Rhodes ..... F41J 9/32 124/36
4,014,310 A * 3/1977 Laporte ..... F41J 9/18 280/38
4,831,996 A * 5/1989 Cero ..... F41J 9/24 74/2
5,226,622 A * 7/1993 LeAnna ..... F16M 13/02 248/219.2
5,427,380 A * 6/1995 Hazard ..... F41J 9/18 273/362
5,470,078 A * 11/1995 Conlan ..... F41J 9/18 273/362
5,720,664 A * 2/1998 Brubacher ..... F41A 33/02 273/362
5,857,451 A * 1/1999 Ciluffo ..... F41B 3/04 124/6
6,159,112 A * 12/2000 Ciluffo ..... A63B 69/0026 124/4
7,263,986 B2 * 9/2007 Lovell ..... F41J 9/30 124/9
8,276,573 B2 * 10/2012 Skell ..... F41A 19/01 340/540

(Continued)

*Primary Examiner* — Alexander R Niconovich
(74) *Attorney, Agent, or Firm* — Rooney IP, LLC

(57) ABSTRACT

A device for launching at least one clay target, the device comprising a clay target thrower, an electric motor, a programable electronic controller, and a battery. The electric motor is coupled to the clay target thrower and is operable to at least assist in propelling the clay target. The programable electronic controller is coupled to the clay target thrower and controls functions of the clay target thrower. The battery is coupled to the clay target thrower and provides power to at least one of the electric motor and the programable electronic controller.

12 Claims, 7 Drawing Sheets

(56) References Cited

U.S. PATENT DOCUMENTS

| | | | | |
|---|---|---|---|---|
| 8,677,983 | B2 * | 3/2014 | Callander | F41J 5/18 124/8 |
| 8,919,331 | B2 * | 12/2014 | Rennert | F41J 9/18 124/1 |
| 9,389,050 | B1 * | 7/2016 | Chen | F41J 9/30 |
| 10,215,542 | B2 * | 2/2019 | Schaller | F41J 9/165 |
| 10,746,513 | B1 * | 8/2020 | Liu | F41J 9/24 |
| 11,137,233 | B1 * | 10/2021 | Liu | F41J 9/30 |
| 2007/0023022 | A1 * | 2/2007 | Lentz | F41J 9/22 124/8 |
| 2015/0204638 | A1 * | 7/2015 | Frazier | F41J 9/24 124/6 |
| 2018/0180390 | A1 * | 6/2018 | Müller | F41J 9/18 |

* cited by examiner

ELECTRIC CLAY TARGET THROWER AND RELATED METHODS

CROSS REFERENCE TO RELATED APPLICATIONS

This application claims the priority of U.S. Provisional Patent Application Ser. Nos. 63/032,262 filed May 29, 2020, 63/032,268 filed on May 29, 2020, and 63/114,294 filed Nov. 16, 2020, the disclosures of which are incorporated herein by reference in their entirety.

TECHNICAL FIELD

Embodiments relate generally to devices for launching target clays, and more specifically, to electric clay target throwers.

BACKGROUND

Electronic clay target throwers, also known as auto throwers, are used by shooters and hunters for sport, competition, and to hone their shooting skills. Electronic clay throwers are operated by a user operating a power switch, typically a push button, hand pad, or foot pedal, for example, which energizes a motor to rotate a throwing arm while loading a large spring. Once the spring is fully loaded, typically 180 degrees from the throwing position, the motor is de-energized. When the motor is de-energized, the throwing arm is released, allowing the throwing arm to swing away from the operator, throwing the target clay. Once the clay is thrown, the user must engage the power switch to throw the next clay.

Generally, clay target throwers are used in remote locations due to the space needed for target shooting. Currently, portable electric clay target throwers utilize lead acid batteries for the power supply. Lead acid batteries have a low energy density and are generally large and heavy. Additionally, lead acid batteries are not an integral part of electric clay target throwers and must be transported separately from the thrower. Typically, a single battery is transported with the thrower and once the battery is depleted of energy, the thrower cannot be used again until the battery is recharged.

The lead acid battery referenced above is only temporarily connected to the thrower using jumper style cables. This style of connection has a high resistance and may present intermittent electrical connection issues. Additionally, since the jumper style cables are not protected by the unit, the high resistance and intermittent electrical connection issues increase as the wire and clips corrode.

Accordingly, the present disclosure contemplates that there is a need for improved electric clay target throwers.

SUMMARY

Generally, a device for launching at least one clay target is provided and comprises a clay target thrower, an electric motor, a programable electronic controller, and a battery. The electric motor is coupled to the clay target thrower and is operable to at least assist in propelling the clay target. The programable electronic controller is coupled to the clay target thrower and controls functions of the clay target thrower. The battery is coupled to the clay target thrower and provides power to at least one of the electric motor and the programable electronic controller. In some embodiments, the device may be powered by 110-120V in place of a battery.

The programable electronic controller may control the launch characteristics of a clay target being propelled by the clay target thrower. In some embodiments, a user input device may enable a user to program the programable electronic controller to adjust the launch characteristics of a clay target being propelled by the clay target thrower, for example. Programing the programable electronic controller may involve inputting and/or selecting the launch characteristics of a clay target being propelled by the clay target thrower, for example. A launch characteristic may include setting the time interval between target clays being thrown. An example of a possible time interval between throws could include throwing a clay every 10 seconds. A launch characteristic may include the total number of target clays being thrown, for example. Programing may include programing a series or sequence of launch characteristics. An example of a possible program sequence may include, turn on the device, throw five clays, turn off the device. In some embodiments, a combination of controls may also be selected, such as turn on the unit, throw five clays every ten seconds, and turn off the unit, for example. In some embodiments, the programable electronic controller may allow a user to select a random program sequence where the programable electronic controller may randomly select a series or sequence of launch characteristics providing a random target clay experience for the user, for example.

The user input device may further comprise an electronic display. The electronic display may include perceptible indicators and the programable electronic controller may activate one or more of the perceptible indicators to communicate an input selected by the user, for example. The perceptible indicators may comprise visual indicators, numbers and/or icons, for example. The icons may be selectively illuminated by the programable electronic controller, for example. Each icon may represent a different launch characteristic of the target clay, for example. The input device may further comprise a touchscreen display. In some embodiments, a user input device with a touchscreen display may enable a user to program the programable electronic controller to adjust the launch characteristics of a clay target being propelled by the clay target thrower, for example. The programable electronic controller may also provide the user feedback regarding status of the clay target thrower such as, state of charge of the battery, calculate the number of throws remaining based on power draw, for example.

In alternative or additional aspects, the programable electronic controller may further comprise a wireless transmitter and receiver coupled to the programable electronic controller. The wireless transmitter and receiver may communicate with a wireless communication device, such as a smart phone, for example. A user, utilizing a smart phone, may be able to remotely program the programable electronic controller. A user may be able to remotely program the number of throws, time intervals, delays, and other clay target thrower functions, for example. Using a wireless communication device, a user may be able to remotely operate a clay target thrower, for example. The remote control function may allow the clay target thrower to be used as a skeet thrower, since a person would not need to be down range to operate the unit, for example.

In some embodiments the programable electronic controller may be carried on the battery or some other portion of the clay target thrower. However, it would also be understood that the programable electronic controller may be carried on or integrated into the battery. If the programable electronic controller is carried on or integrated into the battery, the programable electronic controller will be coupled to the clay target thrower when the battery is coupled to the clay target thrower.

Lithium batteries are preferred presently and have a high energy density compared to lead acid batteries which have traditionally been used to supply the power for electric clay target throwers. The high energy density of lithium batteries permits the same device operation time for a comparably smaller size and lighter weight battery compared to a lead acid battery. Further, the size of a lithium battery with a desirable electric charge for device operation may allow the battery to be integrated into the clay target thrower and the battery may be mounted along rails, for example. Such integration may allow for a blade and terminal electrical connection between the battery and the device and may provide some weather protection against corrosion of the electrical connection. In some embodiments, the lithium battery may be removable for recharging and/or replacement. A removable lithium battery may allow the use of multiple batteries, enabling the device to continue to operate for an extended period by replacing the battery installed on the device, for example.

Generally, a method of using a device for launching at least one clay target is provided, the method comprising programing the launch characteristics of a clay target being propelled by a clay target thrower and operating a clay target thrower to launch a clay target in accordance with the programmed launch characteristics. In some embodiments, a method of using a device for launching at least one clay target may further comprise using a wireless communication device to remotely program the launch characteristics of a clay target being propelled by a clay target thrower. In alternative or additional aspects, a method of using a device for launching at least one clay target may further comprise using a wireless communication device to remotely operate a clay target thrower. Programming the unit via wireless or other methods may involve the user simply inputting directions to a device such as a smartphone via an "app."

Additional aspects and advantages of the invention will become more apparent upon further review of the detailed description of the illustrative embodiments taken in conjunction with the accompanying drawings.

DETAILED DESCRIPTION

Figure 1:
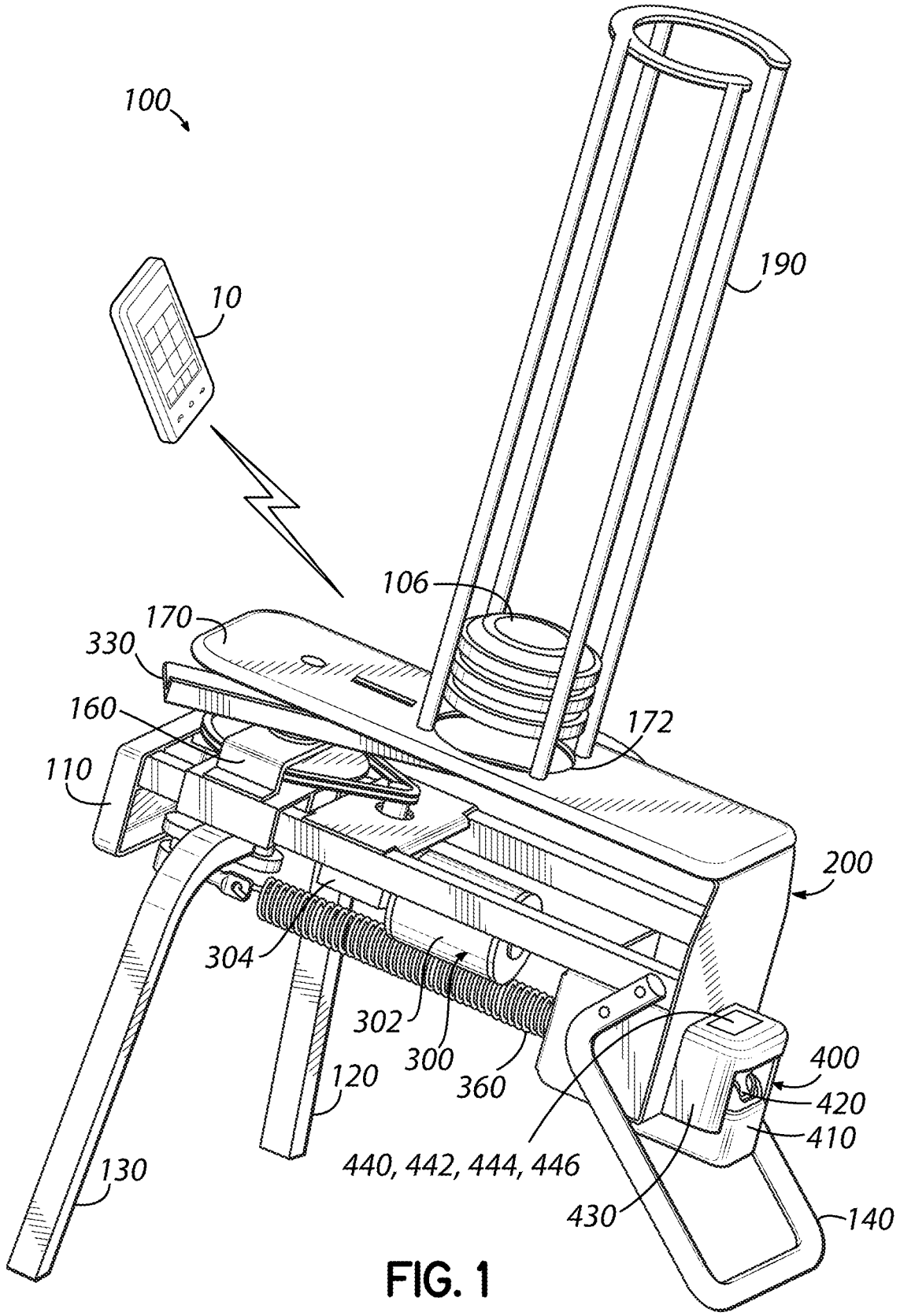
FIG. 1 is a perspective view of an illustrative clay target thrower.
Figure 2:
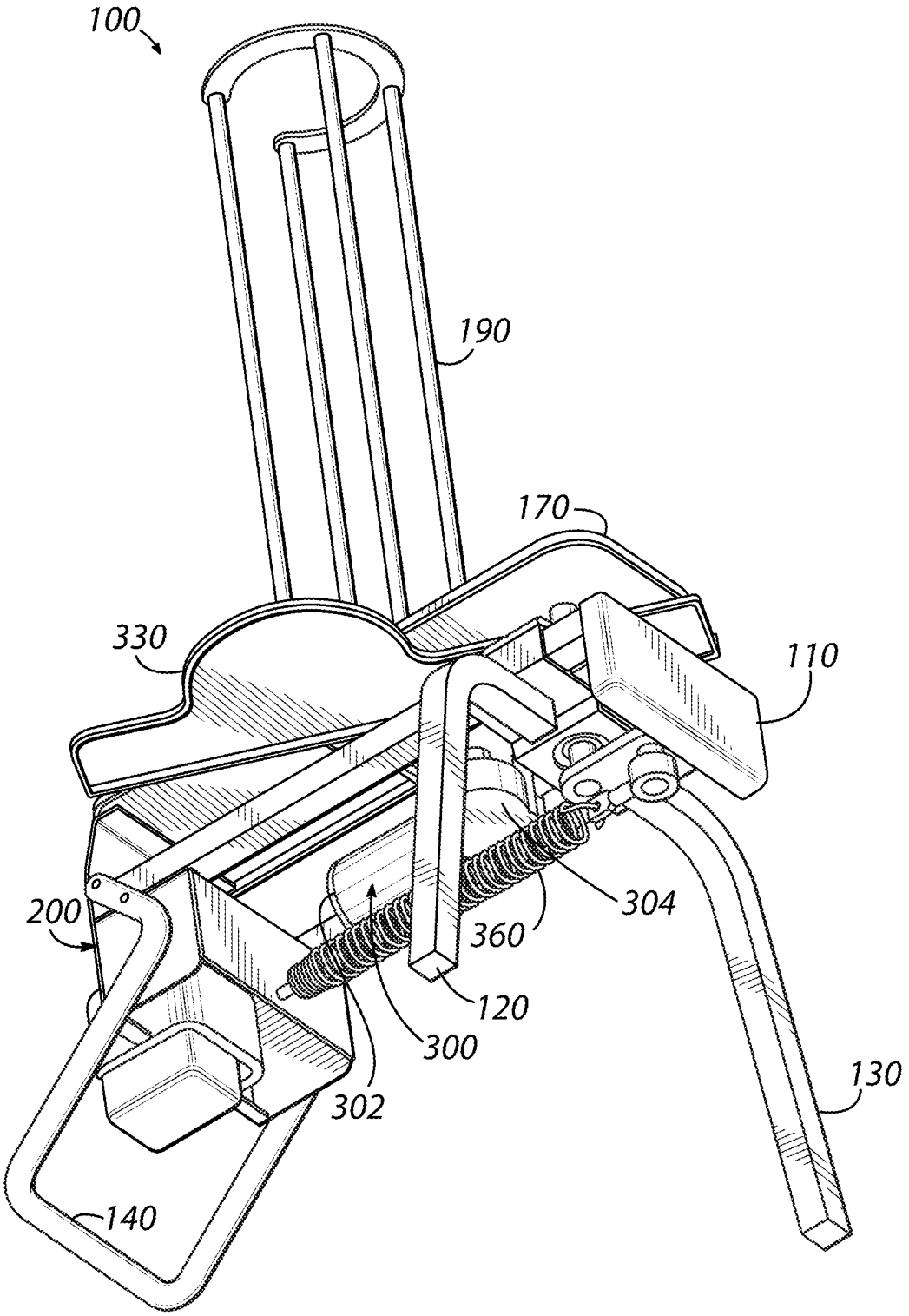
FIG. 2 is an alternate perspective view of an illustrative clay target thrower.
Figure 3:
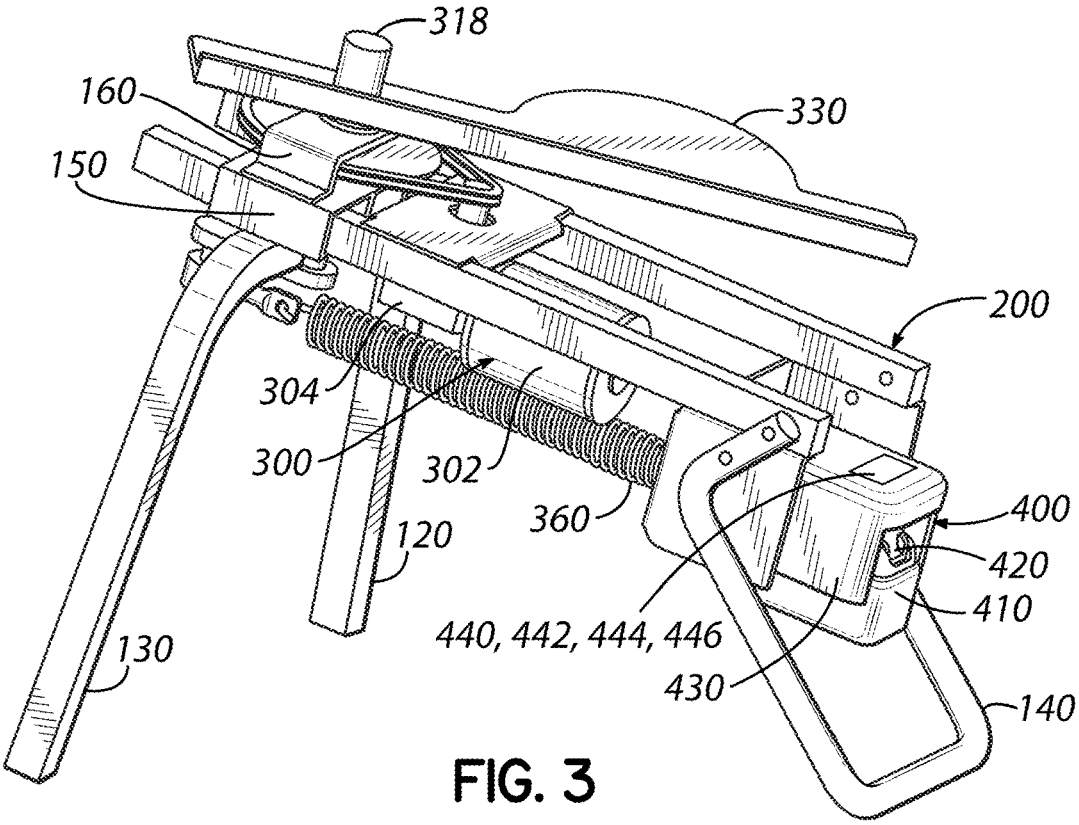
FIG. 3 is a detailed, side/top view of an illustrative clay target thrower mechanism with some components not show for clarity.
Figure 4:
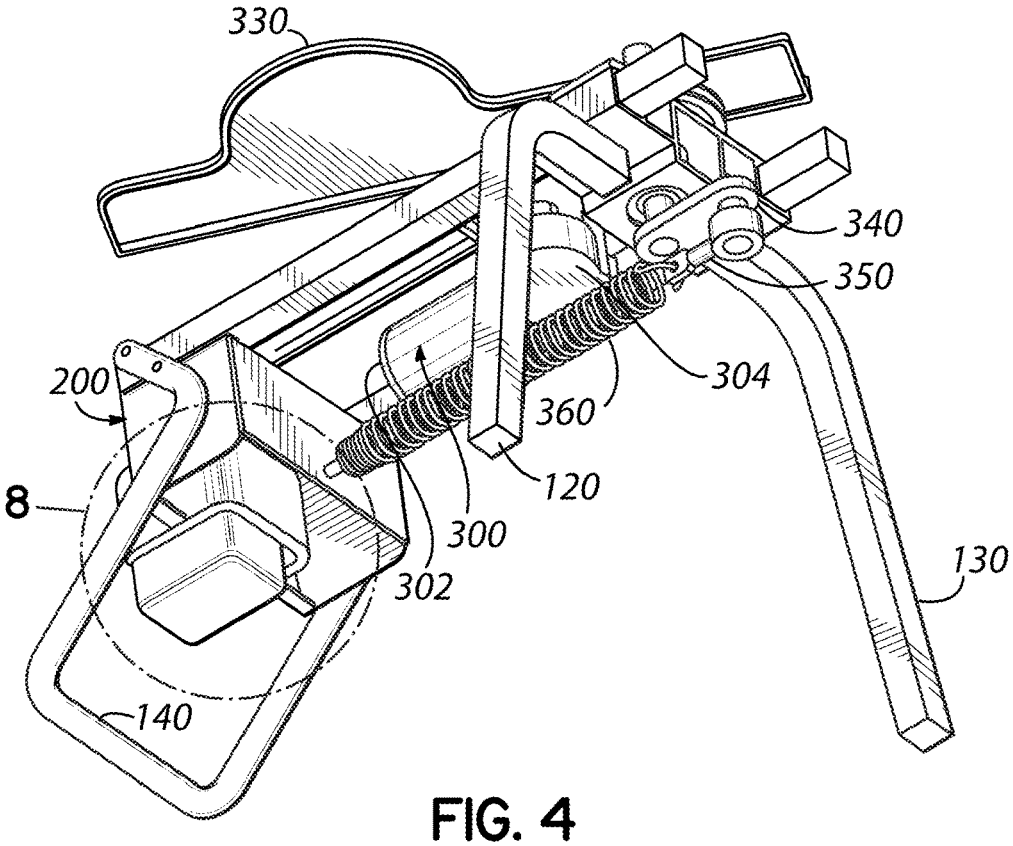
FIG. 4 is a detailed, side/bottom view of an illustrative clay target thrower mechanism with some components not show for clarity.

Referring to FIGS. 1 through 4, an illustrative clay target thrower 100 comprises a front housing 110, a bearing support 150, a gear support 160, a top plate 170, clay guide 190, a support frame 200, a motor assembly 300, a throwing arm 330, an extension spring 360, and a battery and control assembly 400. The clay target thrower 100 further comprises a right front leg 120, a left front leg 130, and a rear leg 140. The clay target thrower 100 may be operated by a user to launch one or more target clays 106.

Figure 5:
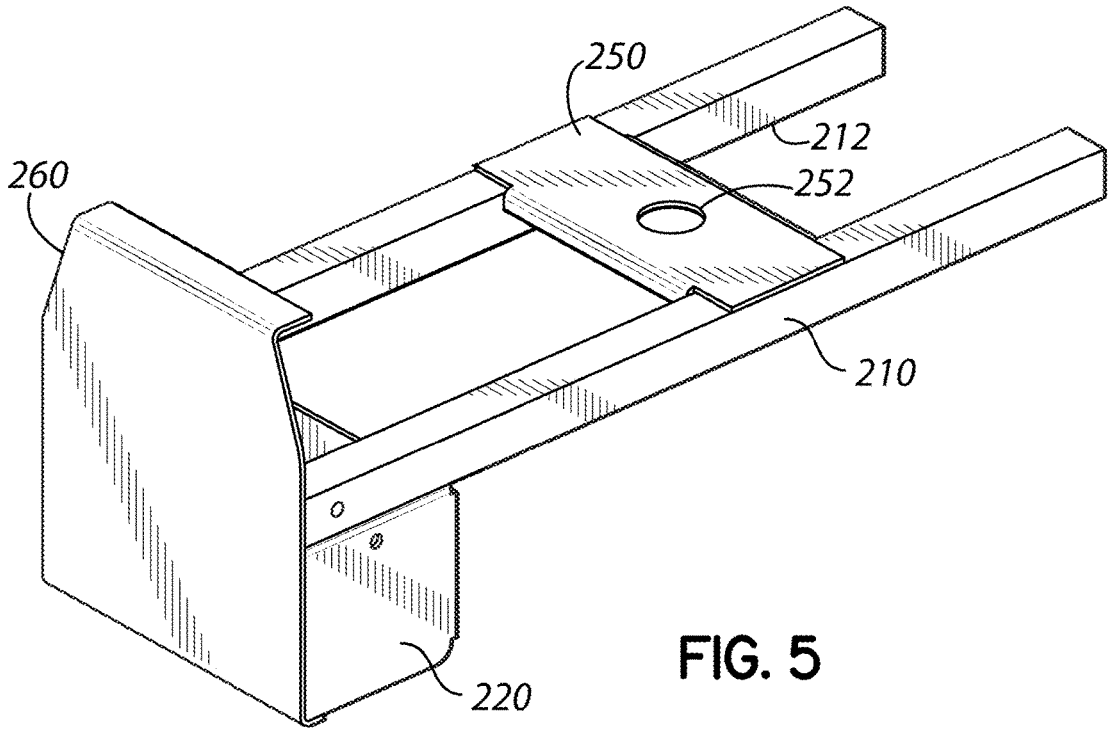
FIG. 5 is a detailed, side/top view of an illustrative support frame.
Figure 6:
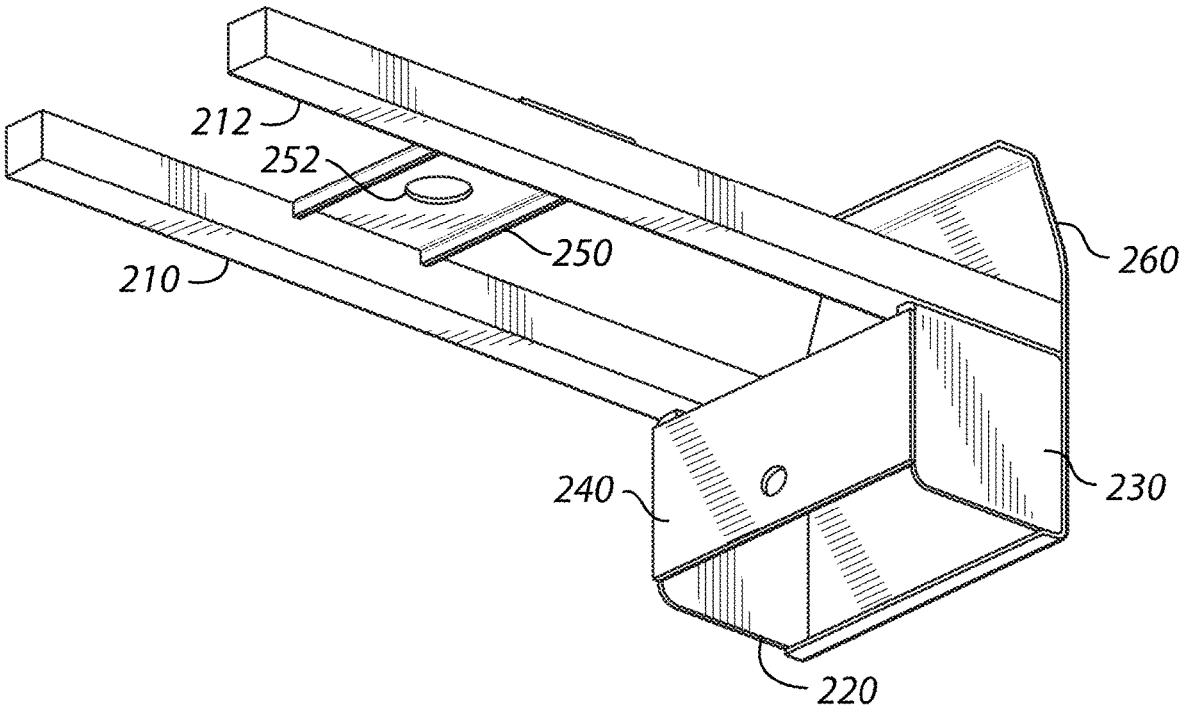
FIG. 6 is a detailed, top/rear view of an illustrative support frame.

Referring to FIGS. 5 and 6, the illustrative support frame 200 comprises a right support tube 210, a left support tube 212, a right support plate 220, a left support plate 230, a spring plate 240, a motor mounting plate 250, and a back plate 260. In this illustrative embodiment, the motor mounting plate 250 is attached to the top of the right support tube 210 and the top of the left support tube 212, generally at the midpoint of the right support tube 210 and the left support tube 212. The motor mounting plate 250 further comprises a pinion hole 252. The back plate 260 is attached to the end of the right support tube 210 and the end of the left support tube 212. The right support plate 220 is attached to the bottom of the right support tube 210 and the back plate 260. The left support plate 230 is attached to the bottom of the left support tube 212 and the back plate 260. The spring plate 240 is attached to the right support plate 220 and left support plate 230 under the right support tube 210 and the left support tube 212 and opposite the back plate 260.

Referring to FIGS. 1 through 6, the top plate 170 is attached to the back plate 260 of the support frame 200. The top plate 170 further comprises a clay hole 172 that is located over the throwing arm 330. The clay guide 190 is attached to the top plate 170 and is centered on the clay hole 172. A user may put one or more target clays 106 in the clay guide 190. When the clay target thrower 100 is operated by a user, the one or more target clays 106 will be fed onto the throwing arm 330.

Figure 7:
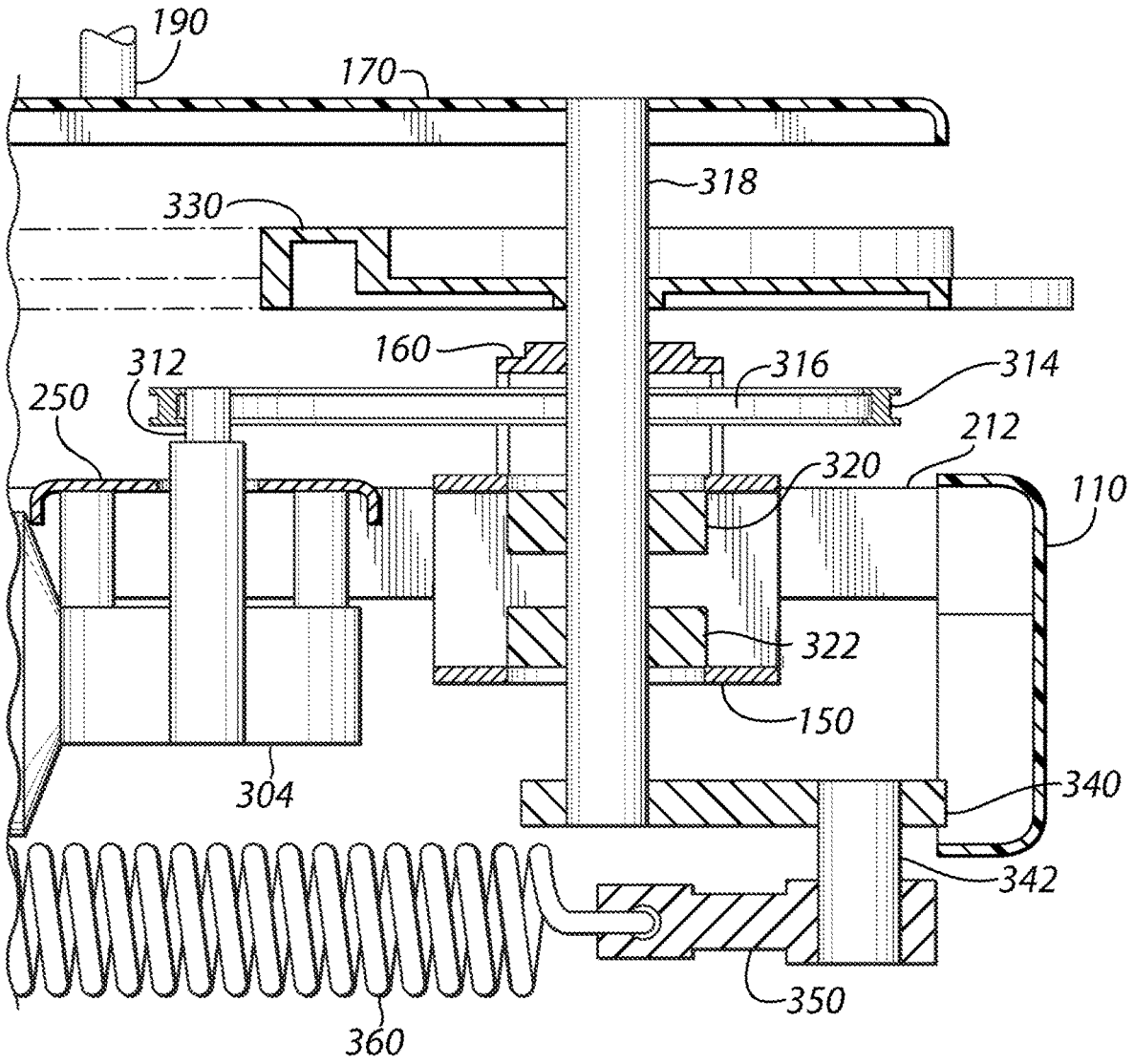
FIG. 7 is a section view of an illustrative throwing arm and drive mechanism.
Figure 8:
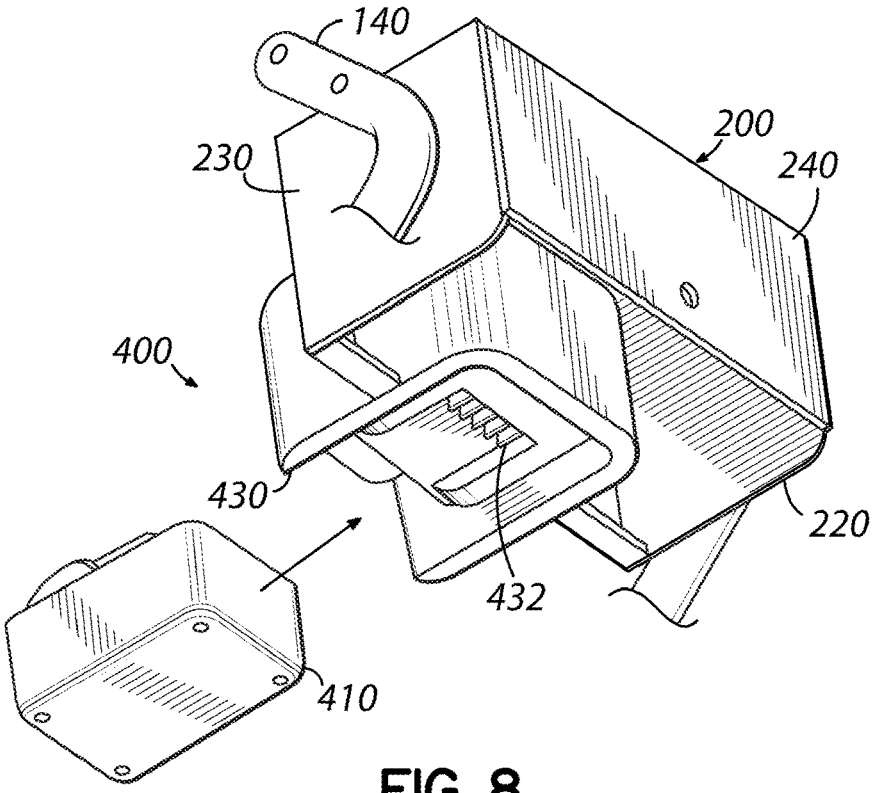
FIG. 8 is a detail view of an illustrative battery and control assembly.
Figure 9:
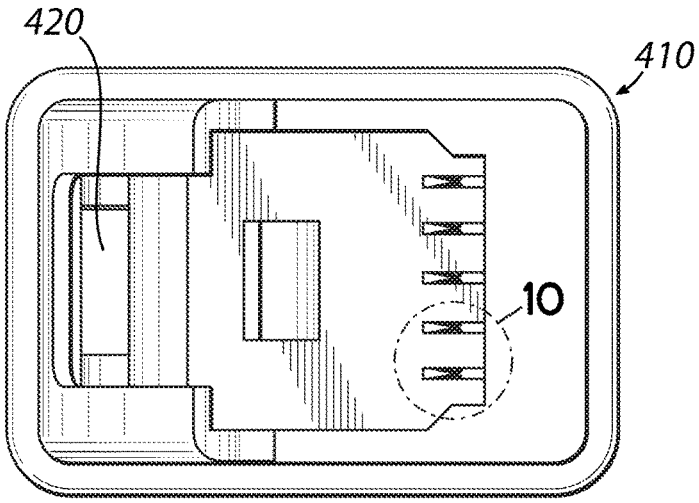
FIG. 9 is a detail view of an illustrative battery.
Figure 10:
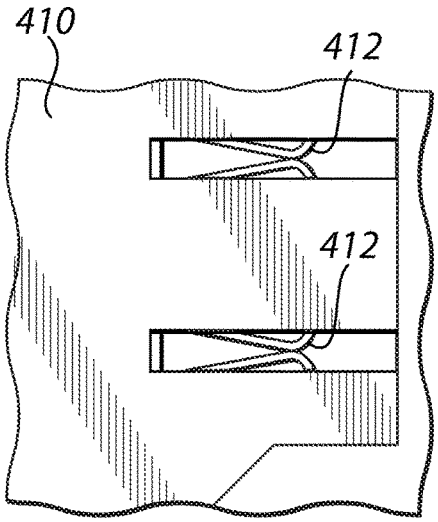
FIG. 10 is a detail view of an illustrative battery clamp.
Figure 11:
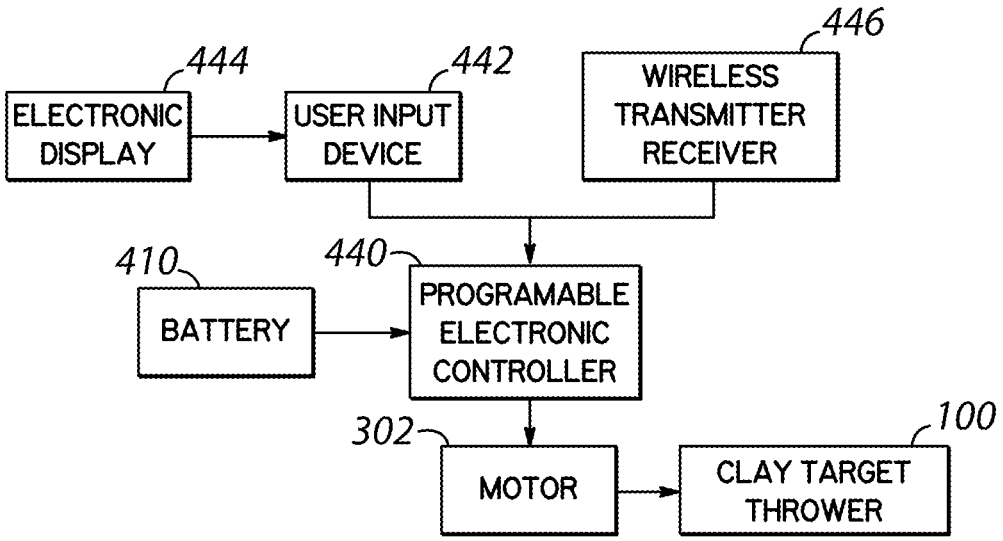
FIG. 11 is an illustrative control block diagram.

Referring to FIG. 7, in this illustrative embodiment, the clay target thrower 100 further comprises a chain 314, a gear 316, an output shaft 318, an upper bearing 320, a lower bearing, 322, a spring hook arm 340, and a spring hook 350. The upper bearing 320 and the lower bearing 322 are installed in the bearing support 150. The output shaft 318 is installed through the centers of the upper bearing 320 and the lower bearing 322. The gear 316 is installed on the output shaft 318 above the upper bearing 320. The spring hook arm 340 is installed on the output shaft 318 below the lower bearing 322. The spring hook arm 340 further comprises a spring hook shaft 342. The spring hook 350 is rotatably attached to the spring hook shaft 342.

Referring to FIGS. 1 through 7, in this illustrative embodiment, the bearing support 150 mounts on the right support tube 210 and left support tube 212 between the motor mounting plate 250 and the ends of the tubes 210 and 212. The right front leg 120 and the left front leg 130 are attached to the bottom of the bearing support is 150. The front housing 110 is attached to the right support tube 210 and left support tube 212. The motor assembly 300 mounts to the bottom of the motor mounting plate 250. The motor assembly 300 further comprises an electric motor 302, a gear drive 304, and a pinion 312 which passes through the pinion hole 252 in the motor mounting plate 250. The chain 314 mechanically couples the pinion 312 and the gear 316 by wrapping around the outer diameters of the pinion 312 and the gear 316. The gear support 160 is mounted over the gear 316 and is attached to the top of the bearing support 150. The output shaft 318 passes through the gear support 160. The throwing arm 330 is attached to the output shaft 318.

The extension spring 360 is attached to the spring plate 240 of the support frame 200 and the spring hook 350. When tensioned, the extension spring 360 provides a force to the throwing arm 330 through the output shaft 318 to launch the target clays 106.

Referring to FIGS. 1 through 4, 8 through 11, an illustrative battery and control assembly 400 comprises a battery 410, a battery interface 430, and a control in the illustrative form of a programable electronic controller 440. In this illustrative example, the battery and control assembly 400 is mounted at the rear of the support frame 200 and is located low and at the rear of the clay target thrower 100. The position of the battery and control assembly 400 may lower the center of gravity of the clay target thrower 100 thereby improving the stability of the clay target thrower 100 which may improve the operational performance of the clay target thrower 100. In this illustrative example, the battery 410 further comprises one or more battery clamps 412 and the battery interface 430 further comprises one or more blade terminals 432. When the battery 410 is installed in the battery interface 430, the battery 410 is electrically coupled to the battery interface 430 through the battery clamps 412 and the blade terminals 432. The battery clamps 412 and the blade terminals 432 may ensure a secure electrical connection between the battery 410 and the battery interface 430. The battery interface 430 may provide protection for the electrical connection from the elements. The battery 410 may be supported on the battery interface 430 on rails, for example. The battery interface 430 is electrically coupled to the motor assembly 300 and the programable electronic controller 440. The programable electronic controller 440 may be sealed within or otherwise protected from the elements within the battery interface 430. The battery 410 further comprises a battery release button 420. The battery 410 may be removed by a user by pressing the battery release button 420. The battery 410 may be removable by a user for recharging or replacement, for example. In some embodiments the programable electronic controller 440 may be carried on the battery 410 or some other portion of the clay target thrower 100. However, it would also be understood that the programable electronic controller 440 may be carried on or integrated into the battery 410. If the programable electronic controller 440 is carried on or integrated into the battery 410, the programable electronic controller 440 will be coupled to the clay target thrower 100 when the battery 410 is coupled to the clay target thrower 100.

In this illustrative embodiment, the programable electronic controller 440 further comprises a user input device 442, an electronic display 444, and a wireless transmitter and receiver 446. The user input device 442 is coupled to the programable electronic controller 440 and allows a user to control aspects of the operation of the clay target thrower 100, such as controlling launch characteristics of one or more clay targets, or controlling other functions of the thrower 100. The electronic display 444 is coupled to the user input device 442 and includes indicators to communicate outputs selected by a user, for example. In some embodiments the electronic display 444 may be a touchscreen display, for example. A user input device 442 with a touchscreen display as part of the electronic display 444 may enable a user to program the programable electronic controller 440 through the electronic display, for example. The wireless transmitter and receiver 446 is capable of being in communication with the programable electronic controller 440 and allows wireless communication with a smartphone 10 or other wireless electronic device, for example. As mentioned previously, a smartphone or other wireless device may be used to program, that is set, desired operational functions of the thrower 100 such as clay target launch characteristics (e.g., launch timing and/or frequency, launch speed, launch angle or height, ground vs. air launch, etc.). Other control functions may be set as well, and any of these functions instead, or in addition, be set direct by way of a user input device, such as device 442, on the thrower 100 itself. The programable electronic controller 440 may also provide the user feedback regarding status of the clay target thrower 100 such as, state of charge of the battery 410, calculate the number of throws remaining based on power draw, for example.

In this illustrative example, electrical power to operate the clay target thrower 100 is supplied by the battery 410. When the clay target thrower 100 is operated by a user, the battery 410 powers the motor assembly 300, and specifically the electric motor 302. The electric motor 302 drives the gear drive 304, the gear drive 304 rotates the pinion 312 and the pinion 312 drives the chain 314. The chain 314 rotates the gear 316 and the gear 316 rotates the output shaft 318. The output shaft 318 rotates the throwing arm 330. When the throwing arm 330 reaches a position under the clay guide 190, one or more clays 106 will drop from the clay guide 190 through the clay hole 172 and onto the throwing arm 330. The output shaft 318 also rotates the spring hook arm 340 and the spring hook shaft 342. The spring hook shaft 342 on the spring hook arm 340 rotates around the centerline of the output shaft 318. The spring hook 350 moves with the spring hook shaft 342 and tensions the extension spring 360. When the extension spring 360 reaches a desired tension and/or the throwing arm 330 reaches a desired position, the motor assembly 300 disengages from the pinion 312. When the motor assembly 300 disengages from the pinion 312 the extension spring 360 will relax. As the extension spring 360 relaxes, the extension spring 360 applies a force to the spring hook 350 and this force is applied to spring hook shaft 342 on the spring hook arm 340. The spring hook arm 340 rotates the output shaft 318. The output shaft 318 rotates the throwing arm 330 launching the target clay 106.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination within and between the various embodiments. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A device for launching clay targets comprising;

a clay target thrower;

an electric motor coupled to the clay target thrower wherein the electric motor is operable to at least assist in propelling the clay targets;

a programmable electronic controller coupled to the clay target thrower;

a battery coupled to the clay target thrower wherein the battery provides power to at least one of the electric motor and the programmable electronic controller, and wherein the programmable electronic controller provides a user feedback on status of the clay target thrower, the electric motor and the battery; and a battery interface on the clay thrower providing a blade and terminal electrical connection between the battery and the clay thrower and supporting the battery on rails such that the battery is removable for recharging and/or replacement.

2. The device of claim 1 wherein the programmable electronic controller is capable of being programmed to set launch characteristics of one of the clay targets being propelled by the clay target thrower, including launch timing and/or frequency, launch speed, and launch angle or height.

3. The device of claim 1 further comprising a user input device coupled to the programmable electronic controller wherein the user input device enables a user to program the programmable electronic controller.

4. The device of claim 3 further comprising an electronic display coupled to the user input device and the electronic display further enables a user to program the programmable electronic controller, the electronic display including icons and the programmable electronic controller activates one or more of the icons to communicate an input selected by the user, and wherein the icons further comprise visual indicators selectively illuminated by the programmable electronic controller.

5. The device of claim 1 further comprising a wireless transmitter and receiver coupled to the programmable electronic controller wherein the wireless transmitter and receiver communicate with a wireless communication device enabling the user to use the wireless communication device to remotely program the programmable electronic controller, wherein the electronic display includes icons and the programmable electronic controller activates one or more of the icons to communicate an input selected by the user, and wherein the icons further comprise visual indicators selectively illuminated by the programmable electronic controller.

6. The device of claim 1, wherein the programmable electronic controller is programmed to cause the clay target thrower to provide a number of throws of the clay targets and the programmable electronic controller provides feedback to the user including calculating the number of throws remaining based on power draw from the battery.

7. The device of claim 1, further comprising an electronic display coupled to the programmable electronic controller, wherein the programmable electronic controller provides the feedback through the electronic display.

8. A method of using a clay target thrower operated by a battery for launching clay targets, the method comprising:

coupling a battery to a battery interface on the clay thrower with a blade and terminal electrical connection thereby supporting the battery on rails such that the battery is removable for recharging and/or replacement;

using a programmable electronic controller to program launch characteristics of the clay target being propelled by the clay target thrower;

coupling an electric motor to the clay target thrower;

providing power to at least one of the electric motor and the programmable electronic controller to at least assist in propelling the clay targets;

providing a user feedback on status of the clay target thrower, the electric motor and the battery with the programmable electronic controller; and operating the clay target thrower to launch the clay target in accordance with the programmed launch characteristics.

9. The method of claim 8 further comprising using a wireless communication device to remotely program the launch characteristics of the clay targets being propelled by a clay target thrower.

10. The method of claim 8 further comprising using a wireless communication device to remotely operate the clay target thrower.

11. The method of claim 8, wherein programming launch characteristics further includes programming the clay target thrower to provide a number of throws of the clay targets, and the method further comprises:

providing feedback to the user including calculating the number of throws remaining based on power draw from the battery.

12. The method of claim 8, wherein providing a user feedback further comprises providing the feedback through an electronic display of the programmable electronic controller.

* * * * *